United States Patent [19]

Hjersted

[11] 4,197,139

[45] Apr. 8, 1980

[54] PROCESS FOR THE RECLAMATION OF ACID FROM SPENT PICKLE LIQUOR

[76] Inventor: Norman B. Hjersted, 3401 Coleman Rd., Kansas City, Mo. 64111

[21] Appl. No.: 936,036

[22] Filed: Aug. 23, 1978

[51] Int. Cl.[2] ..... B08B 7/04

[52] U.S. Cl. ..... 134/12; 134/13; 423/DIG. 1; 423/DIG. 2

[58] Field of Search ..... 134/12, 13, 10; 423/DIG. 1, DIG. 2

[56] References Cited

U.S. PATENT DOCUMENTS

| | | | |
|---|---|---|---|
| 1,023,458 | 4/1912 | Diescher | 134/13 UX |
| 1,269,441 | 6/1918 | Hoffman et al. | 423/DIG. 2 X |
| 2,235,658 | 3/1941 | Waterman | 148/8 |
| 2,428,221 | 9/1947 | Hudson | 134/12 X |
| 2,616,790 | 11/1952 | Swindin | 423/DIG. 2 X |
| 2,721,562 | 10/1955 | Irvine | 134/12 X |
| 2,886,420 | 5/1959 | Jones et al. | 41/42 |
| 3,310,435 | 3/1967 | Robinson et al. | 134/3 |
| 3,399,964 | 9/1968 | Michels et al. | 23/154 |
| 3,442,608 | 5/1969 | Addinall et al. | 23/154 |
| 3,443,991 | 5/1969 | Kremm | 134/3 |
| 3,445,284 | 5/1969 | Robinson et al. | 134/3 |
| 3,495,945 | 2/1970 | Allison et al. | 23/260 |
| 3,502,432 | 3/1970 | Phelps | 23/154 |
| 3,669,623 | 6/1972 | Allison et al. | 23/154 |
| 3,772,105 | 11/1973 | Shipley | 156/19 |
| 3,784,455 | 1/1974 | Parikh et al. | 204/130 |
| 4,010,240 | 3/1977 | Plessen et al. | 134/12 X |
| 4,144,092 | 3/1979 | Krepler | 134/12 |

FOREIGN PATENT DOCUMENTS 1303190 7/1971 Fed. Rep. of Germany .... 423/DIG. 2

OTHER PUBLICATIONS

Kolek, "Hydrochloric Acid Recovery Process", *Chem. Engnr. Prog.*, vol. 69, (1973), p. 47.

*Primary Examiner*—Marc L. Caroff

*Attorney, Agent, or Firm*—Fishburn, Gold & Litman

[57] ABSTRACT

A process for reclaiming pickling liquor acid from spent pickle liquor comprises injecting the spent liquor from a metal pickling process into a container having an upper section, a lower liquid holding section and a heating means. The spent pickle liquor in the container lower section is heated, and the water therein is vaporized and returned to the pickling process in a vapor state to be absorbed therein and provide heat thereto. A substantial portion of the unused acid is removed from the spent pickle liquor and is also returned to the pickling process without cooling.

17 Claims, 3 Drawing Figures

PROCESS FOR THE RECLAMATION OF ACID FROM SPENT PICKLE LIQUOR

BACKGROUND OF THE INVENTION

This invention relates to the pickling of metals by passing the same through an acid bath, and in particular to the reclamation of unused acid from and concentration of spent pickle liquor produced by a metal pickling process.

In the production of metals, and in particular ferrous metals such as steel, metal oxide scales often form on the surface of the metals. To remove such scale, the metal is typically passed through an acid bath referred to as pickle liquor. Frequently, the pickle liquor used is hydrochloric or sulfuric acid. As the metal is treated, metallic salts are produced by the corrosive action of the acid bath. The corrosive action also occurs on the unoxidized or descaled portions of the metal being pickled, which is an undesirable consequence of the pickling process as the metal so removed is wasted. Sometimes an inhibitor such as thiourea is included in the bath which somewhat inhibits the corrosion of the unscaled metal while having little effect on the descaling action. The formation of the metallic salts uses and thus reduces the concentration of the pickle liquor acid, and as will be discussed later, also often undesirably enhances the corrosive effect on the descaled metal. Hence, the metallic salts must be removed from the pickle liquor, and fresh acid added thereto. Spent pickle liquor which is relatively high in metallic salts and low in acid is thus typically bled off from the pickle liquor bath. The unused acid in the spent liquor is, therefore, lost unless recovered. Disposal of the spent liquor containing unused acid is difficult both due to total volume of the spent pickle liquor and low PH caused by the acid. Federal and state regulations on dumping of low PH materials are becoming increasingly strict, thus this low PH material generated from the pickling process normally requires neutralization before placing in a landfill, deep welling or other disposal site.

A number of processes have been developed for converting the metallic salts of various ferrous metal pickling processes, wherein the pickling acid is hydrochloric acid, to iron oxides, often by combusting oxygen and fuel in the presence of the iron chlorides produces therein. However, these processes require substantially increased inputs of energy and often need careful monitoring of the operation. Hence these processes may require substantial additional energy and labor inputs as compared to the requirements of operating a pickling process without any recovery system.

In addition, spent pickle liquor metallic salt concentration processes are sometimes used in conjunction with pickling processes using hydrochloric acid which include a single stage evaporator and the absorption or condensation of the acid-water gaseous vapors or overheads released from the evaporation before returning of the overheads to the pickling bath. This process in general uses separate energy supplies in the form of heat to vaporize the acid-water mixture and to heat the pickling baths to their proper operational temperature. Thus, most spent pickle liquor concentration processes require substantially greater energy input than does a pickling process which does not concentrate the spent pickle liquor.

The marketability of some of the metallic salts is low and thus they are disposed of by standard methods of waste disposal, however, many of the salts such as iron chlorides have a relatively good commercial market. Normally salability improves as the salt concentration of the solution containing the metallic salts increases, and as the free or unused acid concentration therein decreases. Marketability is also significantly enhanced by a decrease in free or unused acid content of the concentrated metallic salts solution. Therefore, the unused acid removal and concentration of the remaining salt solution provided by the present invention, as will be discussed later, also improves the value and salability of the concentrated spent pickle liquor. In addition, the ferrous chlorides generated in the ferrous metal pickling processes using hydrochloric acid are not as marketable as ferric chlorides and it is thus desirable to convert the ferrous chloride to ferric chloride.

SUMMARY OF THE INVENTION

Therefore, the principal objects of the present invention are: to provide a process for reclamation of unused acid from spent pickle liquor; to provide such a process which absorbs volatile acid and water vapors in a gaseous state directly into the pickle liquor bath; to provide such a process which requires little additional energy and manpower; to provide such a process which concentrates spent pickle liquor; to provide such a process which uses multi-stage stripping to remove relatively volatile unused acid from the spent liquor; to provide such a process which will reduce corrosion of the metal being pickled; to provide such a process which converts ferrous chloride to ferric chloride; to provide such a process which separates relatively non-volatile acids from the spent pickle liquor by crystallization and removal of metallic salts contained therein, leaving the spent pickle liquor as essentially unused acid which can be returned to the pickle liquor bath; to provide such a process which is capable of an extended useful life, and is particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

DESCRIPTION OF PREFERRED EMBODIMENTS

Figure 1:
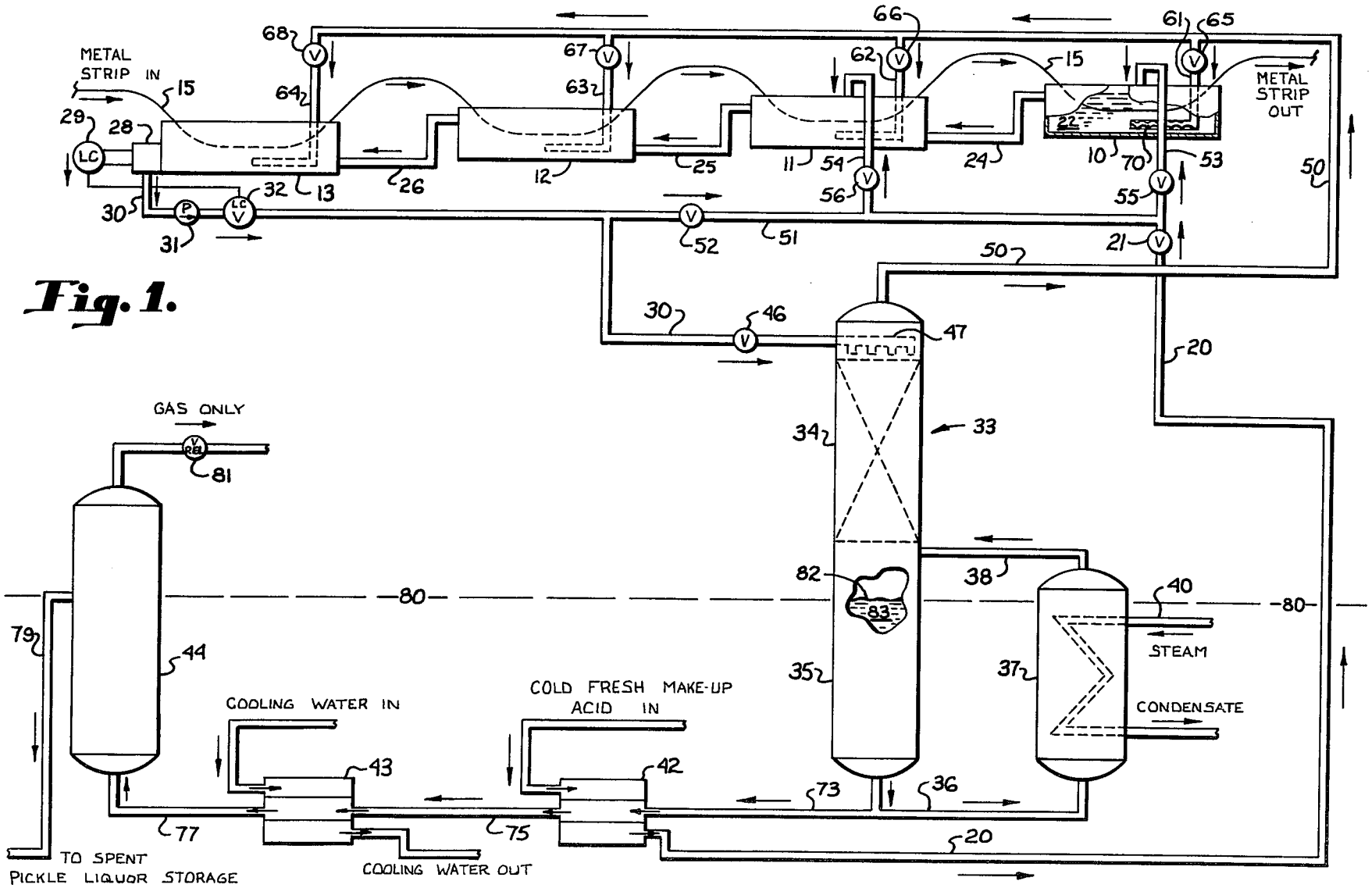
FIG. 1 is a schematic flow diagram of an acid reclamation process for a ferrous metal pickling process including certain structural features of the processing equipment.

In general FIG. 1 shows schematically an embodiment of a process comprising a metal pickling process in combination with a novel process of reclaiming unused acid from spent pickle liquor.

The metal pickling process contemplated by the present invention can be used to pickle a wide variety of metals and may use a wide variety of pickling acids. In the embodiment illustrated in FIG. 1 the metal to be pickled is a ferrous metal, and the pickling acid is hydrochloric acid. However, the description of this specific pickling process is not intended to exclude pickling processes comprising other metals or pickling acids, as demonstrated by the modified embodiments discussed hereinafter.

The spent pickle liquor acid reclamation process, as used in combination with the above mentioned metal pickling process, receives spent pickle liquor from the metal pickling process, separates a major portion of the unused acid from the metallic salts contained in the spent pickle liquor, returns the unused acid to the metal pickling process, and concentrates the remaining spent pickle liquor solution which contains the metallic salts. In the embodiment illustrated in FIG. 1, the spent pickle liquor acid reclamation process operates such that spent pickle liquor is withdrawn from a ferrous metal pickling process, water is vaporized from the spent pickle liquor in a container, a major portion of the unused hydrochloric acid is stripped from the spent pickle liquor in a multi-stage stripper by allowing the vaporized water to rise therethrough and act as a stripping gas, the acid-water mixture is returned in a gaseous state to the metal pickling process, and the concentrated pickle liquor containing the metallic salts is removed to storage or other disposition. However, the description of this specific acid reclamation process is not intended to exclude other acid reclamation processes as will be described and claimed herein.

In the embodiment illustrated in FIG. 1 the metal pickling process comprises an acid bath, that is, a vat or tub containing a somewhat dilute acidic solution (pickling liquor, including a pickling acid (the process as described herein uses hydrochloric acid) along with beneficial and nonbeneficial reaction products of the pickled metal and pickling acid. The acid bath is heated to a selected temperature for optimum scale removal from the metal, yet with minimum corrosion of the descaled metal. The optimum temperature is normally a function of acid concentration in the bath, and certain other factors as will be discussed later. The ferrous metal is selectively passed through the pickle liquor. The metal may be a long pliable strip or pieces which must be conveyed by some means. As pickling acid is used up or consumed in the pickling process, mostly by reaction with the scale and base metal resulting in the consequent production of iron chlorides, fresh acid must be added and spent pickle liquor must be withdrawn from the vat.

In FIG. 1, the bath is composed of four tubes 10, 11, 12 and 13. The ferrous metal comprises a long pliable strip 15 which is guided by rollers (not shown) through tubes 13, 12, 11 and 10 in that order. During normal operation, fresh make-up acid of selected concentrations is delivered to tub 10 by pipe 12. During continuous operation fresh acid flow may be regulated by a valve 21. The pickle liquor 22, having partially reacted with the metal in tub 10, overflows tub 10 through line 24 into tub 11. The liquid in tub 11 is thereby of weaker concentration in acid and higher in iron chloride concentration than that in tub 10. Likewise each tub overflows into the next consecutive tub in the opposite order with which the strip 15 passes therethrough, such that lower acid concentrations and higher iron chloride levels exist in each consecutive tub. Thus, the strip 15 passes through the tub 13 with the weakest acid concentration first, and the tub 10 with the strongest acid concentration last.

The invention does not require the particular alignment of the tubs as discussed above. The process according to the invention would also be functional with a pickling process having greater or fewer tubs than four, including one, and would be functional if the ferrous metal strip were interjected into the pickling liquor in a manner other than as described, such as by dipping in sections.

The acid concentration of the pickle liquor 22 varies as discussed above throughout the pickling process. In a conventional process using hydrochloric acid, the concentration of the fresh make-up acid may be in the nature of about 30% by weight acid (the concentration of acid can be varied by water dilution as required for desired process results). The average concentration in the first tub may be in the nature of 15% acid by weight. This varies, however, and is somewhat a function of acid bath temperatures and residence time of the ferrous metal strip. The concentration of the acid in the final tub 13 is in the nature of about 8% by weight, whereas in conventional pickling processes which do not reclaim the unused hydrochloric acid, the acid concentration in the final tub is typically 2% by weight. This low acid concentration in conventional pickling processes is normally dictated by the economics of disposing of as little unused acid as possible and yet still pickling the metal strip 15 within a reasonable residence time. As will be discussed in greater detail, such low acid concentrations in the final tub also require high acid temperatures and necessarily result in coexistant high iron chloride concentrations; both high temperatures and high iron chloride concentrations in turn result in increased corrosion of the metal strip over what is necessary for proper scale removal and metal protection in the pickling process.

The acid used in the pickle liquor processes in FIG. 1 is hydrochloric acid which is an aqueous solution of hydrogen chloride (HC1). However, it is not intended that the use of the invention should be limited to processes using hydrochloric acid. The invention, as embodied in FIG. 1, would be functional with any acid which has a relatively low boiling point. As used herein, a volatile acid is understood to mean one which vaporizes upon heating before or with water mixed therewith, or which vaporizes within a close temperature proximity to the temperature at which water mixed therewith vaporizes (in particular, not more than 50° Centrigrade (C) above the water) and which in all cases must necessarily volatilize before the metallic salts mixed therewith. Thus, while hydrochloric acid is referred to frequently in this embodiment, other volatile acids, for example hydrochloric acid and nitric acid, would also be functional according to the metal pickling process contemplated herein.

While many pickling processes are used to pickle ferrous metals, as is described herein, this is not meant to exclude a process in which metal to be pickled is other than ferrous, for instance aluminum.

Spent pickle liquor is pickling liquor of relatively low acid concentration and high metallic salt concentration wherein the liquor is no longer functional in pickling the metal strip 15 in view of the economics of discarding unused acid and actual ability to further pickle the metal in each individual situation. In the illustrated pickling process, spent pickle liquor overflows tub 13 into collection pot 28. The spent pickle liquor is transferred by conduit 30 to a pump 31. An automatic level controller 29 is connected with the spent pickle liquor collection pot 28, and opens and shuts a control valve 32 as necessary to maintain a constant level in the spent liquor collection pot 28.

In conventional pickling processes without unused acid recovery, the spent pickle liquor is frequently delivered by conduit 30 to storage, a waste removal system, or to other appropriate disposition. The spent liquor in such a system contains unused acid which must normally be neutralized before final disposition. Due to the large bulk of spent pickle liquor generated from such systems, substantial cartage expense and/or burial expense in landfills or deep wells is required.

As illustrated in FIG. 1, the unused acid reclamation process basically requires three elements: a tower, a liquid level holding pot and heating means. There is no restriction that these elements be separate vessels or apparatus or that they be all part of the same structure. It is also understood that each element could be composed of a multiplicity of separate structures, that is for instance that the tower could be comprised of several separate vessels, each including several separation stages which will be discussed in greater detail hereinafter.

In the illustrated embodiment, the major elements are contained in a container or column 33 having an upper stripping section 34 (the tower) and a lower liquid level holding pot 35 and a thermo-syphon reboiler 36 (the heating means).

The column upper stripping section 34 comprises a multi-stage separation tower. (By multi-stage separation is meant the common chemical engineering use of the terminology, for instance see King, *Separation Processes,* published by McGraw-Hill 1971). The upper section 34 may be comprised of plate or tray separation stages, a packed column using such trade or generically named packing devices as Raschig rings, Lessing rings, tellerettes, Pall rings, Intralox saddles, Berl saddles, or other multi-stage separation processes, especially those suitable for gas stripping from liquid. The illustrated column upper section 34 is a vessel containing Raschig ring packing.

The column lower section 35 comprises a liquid holding pot. The lower section 35 may be a separate vessel from the upper section 34, however, in the illustrated embodiment both sections 34 and 35 are one continuous vessel.

The heating means may be any suitable device for adding heat to the liquid in the liquid holding pot 35. This may be a heating device located internally of the pot 35, such as an electric heating coil, or externally, such a mechanical recirculation system including a pump and a heat exchanger, wherein the liquid is circulated by the pump from the holding pot 35 to the heat exchanger for heat input therein and then returned to the holding tank 35. In the illustrated embodiment, the liquid in the holding pot 35 is conveyed by conduit 36 to a thermo-syphon (that is, the heated liquid in the tank rises, drawing new liquid into the bottom) reboiler tank 37 and then returned to the holding tank 35 by conduit 38 after heating. A closed steam coil supplies heat to the reboiler tank and conveys away condensate after conventional trapping (not shown).

The embodiment illustrated in FIG. 1 includes two heat exchanges 42 and 43 for cooling concentrated spent pickle liquor as will be discussed hereafter, and a constant liquid level overflow tank 44 which maintains the liquid level in the holding pot 35, also as will be discussed further hereinafter.

To use the acid reclamation process, the spent pickle liquor is first transferred by conduit 30 from the spent pickle liquor collection pot 28 through a valve 46 and a distribution nozzle 47 into the top of the column 33. If desired, a recycle stream of spent pickle liquor can also be directed back to the high acid concentration tubs 10 and 11 through a line 51 and a valve 52 to dilute the acid concentration therein. The recycled acid mixes with the fresh make-up conveyed in the line 20, and the mixture is delivered to the tubs 10 and 11 by lines 53 and 54 through valves 55 and 56 respectively. Dilution of the fresh make-up acid by recirculation of spent pickle liquor is not always required, but may be appropriate where the use of the process disclosed herein creates an overconcentration of acid in the high concentration tubs 10 and 11 and especially in the tub 10.

The spent pickle liquor is distributed by the nozzle 47 into the top column upper stripping section 34, whereupon it cascades down through the packing contained therein to the holding pot 35. The liquid collects in the holding pot 35 and the reboiler tank 37. Closed steam in the nature of 150 pounds per square inch gauge (PSI) is applied through the steam coil 40 to the reboiler tank 37 whereupon a portion of the water and the HCl are vaporized from the spent pickle liquor container therein. As was mentioned before, other heating means are functional and would include steam of lesser or greater pressure, for instance, 200 PSI steam. The steam flow to the reboiler tank may be controlled by conventional automatic temperature control means (not shown). The water vaporized in the reboiler tank 37 is returned to the column 33 through conduit 38 and therein rises through the column upper stripping section 34. In the upper section 34, the water vapors strip the HCl from the downflowing, cascading spent pickle liquor in a stage equilibrium process, wherein the stripped HCl enters into the gaseous phase with the water vapors. The acid concentration of the spent pickle liquor reaching the holding pot 35 is basically dependent on the original acid concentration of spent pickle liquor, and the number of stages present which may be calculated by standard chemical engineering techniques.

The water and stripped HCl vapor normally exit the column 33 under pressure. The pressure of the vapors varies with operation conditions, heating means used, and type of pickling acid used. In the embodiment illustrated in FIG. 1, the pressure of the vapors is in the nature of 3 PSI, however, this could vary to much higher pressures (over 100 PSI) or may at times be a vacuum. The water and HCl vapors, sometimes referred to as column overheads, are conveyed from the column 33 in a gaseous state by line 50 directly to the tubs 10, 11, 12 and 13 through lines 61, 62, 63 and 64 and associated valves 65, 66, 67 and 68 respectively. The line 50 is insulated or otherwise treated to avoid condensation of the vapors therein. The return of the column overhead vapors directly to the pickling bath without condensation is important, as it allows the heat entrapped in the vapors to be used to raise the temperature of the tubs 10, 11, 12 and 13. In many conventional process open or closed steam is used directly on the pickle liquor 22 in the tubs 10, 11, 12 and 13 to heat the same to pickling process temperatures. The potential driving force of this steam for separating the acid from the spent pickle liquor and concentration thereof is thereby not used in the conventional processes. In the present invention the steam heat input is exchanged in the reboiler tank 37 with spent pickle liquor with the resultant creation of water and HCl vapors at a pressure in the nature of 3 PSI, which vapors are thereby returned to the tubs 10, 11, 12 and 13 for recovery of unused acid and for the resultant heating thereof. While there are of course some heat losses between the reboiler tank 37 and the tubs 10, 11, 12 and 13 due to normal inefficiencies, in this embodiment as illustrated in FIG. 1 and described above, there is a substantially equivalent amount of energy in the form of heat applied to the tubs 10, 11, 12 and 13 through the overhead vapors and the fresh make-up acid (having been heated in the heat exchanger 42), as is applied to the reboiler tank 37.

The column overheads are normally distributed directly into the pickle liquor 22 in the tubs 10, 11, 12 and 13, whereby the vapors are absorbed into the solution therein. This may be accomplished for instance by sparging the vapors from distribution manifold tubes or other devices such as porous nozzles or plates directly into the pickling liquor 22. Or an aspiration jet could be used to distribute the overheads wherein a pump (not shown) circulated pickle liquor from tub 10 through an aspirator jet (not shown) to which the overheads are fed whereby the overheads are absorbed and heat the recirculated pickle liquor which is then returned to the tub 10. In the illustrated embodiment the overheads return to the tubs 10, 11, 12 and 13 through sparging nozzle 70. Normally the vapors are returned to the tub 10, however, as shown above they may be directed to the other tubs 11, 12 and 13, if it is desirous to increase the acid concentration therein.

Even though the vapor pressure in the overhead is usually somewhat less than the steam supplying heat to the reboiler 37 through line 40, the heating values as measured by enthalpy are quite similar. Thus, in the present process little heating effect is lost by injecting the heat from the steam at the reboiler tank 37, rather than, directly inputing same into the tubs 10, 11, 12 and 13; yet steam has indirectly served two useful purposes by acting as a driving force in separating the unused acid from the spent pickle liquor and concentrating the spent pickle liquor by vaporizing water threfrom. This has been accomplished with very little additional input of energy over what would normally be used in the metal pickling process with consequent little additional energy expense. A major savings in expense is realized because of the concentration of the spent pickle liquor due to evaporation of water therefrom, resulting in reduced storage expense and substantially reduced transportation and disposal expense or if the liquor is salable, as is liquor containing iron chlorides, the quality and value of the liquor is greatly increased by concentration thereof. Because the concentrated acid is substantially reduced in unused acid concentrations relative to the untreated spent pickle liquor (any reduction is beneficial), the cost of neutralizing the spent pickle liquor before disposal is also similarly reduced.

Returning attention to FIG. 1, the concentrated spent pickle liquor exits the bottom of the column liquid holding pot 35 through line 73 and enters heat exchanger 42, wherein fresh cold make-up acid in line 20 is heated by the residual heat from the concentrated spent pickle liquor. This results in additional energy savings in the form of reduced heat consumption. The concentrated spent pickle liquor exits heat exchanger 42, and is conveyed by line 75 to the second heat exchanger 43, wherein the concentrated spent pickle liquor may be further cooled by water if necessary.

The cooled spent pickle liquor is carried by line 77 from heat exchanger 43 to an overflow tank 44, which serves to maintain the proper operating liquid level in the column liquid holding pot 35. Level maintenance is accomplished by an overflow conduit 79 at the liquid level desired, which consequently maintains about the same operating liquid level in the overflow tank 44, the liquid holding pot 35, and the reboiler tank 37, as is shown by phantom line 80, with some slight variances due to pressure surges. A normal operating level 82 for liquid 83 in the column lower section 35 can be seen in FIG. 1. The concentrated spent pickle liquor having substantially reduced acid content which overflows tank 44 is transferred to storage (not shown) for later disposition which may include beneficial recovery and use of the metallic salt or disposal as waste. The liquid level as shown by line 80 should be at least high enough to substantially cover the steam coil 40, or other heating means in the reboiler tank 37 with spent pickle liquor to be concentrated. The overflow tank 44 has a gas relief valve 81 on top thereof to release gaseous buildups therefrom. The relief valve 81 relieves to a caustic scrubber system (not shown) which vents and scrubs the pickling bath.

The amount of the acid in the spent pickle liquor to storage according to the embodiment of FIG. 1, is reduced from the amount in the spend pickling liquor as withdrawn from the pickling process. The concentration of the acid in the liquor to storage may vary according to the number of stages in the upper stripping section 34, as was previously discussed, especially as dictated by the economics of adding additional stages versus the reduction in concentration. Concentrations would be expected to normally be in the range of a trace to 2.0 by weight acid. (Note, the concentration of acid is increased by the reduction in the volume of the spent pickle liquor in the column 33, thus even though the concentration of acid in and out of the column 33 may be similiar, the amount of acid will be substantially reduced by passage through the column 33.)

The examples which follow serve to illustrate the use of the invention in the reclamation of acid from spent pickle liquor generafted by a ferrous metal pickling process as described above and shown in FIG. 1. These examples are presented only to offer an exemplary comparison between a metal pickling process with no acid reclamation, and a typical embodiment of the present invention, wherein the metal pickling process is used in combination with the acid reclamation process previously described. The following examples are set forth only to provide a vehicle to describe the comparative benefit and effects of the present processes and are not intended to be limiting. Each example is based on a given steel strip production, having a pickling residence time for the metal of 2.6 minutes, and an assumed 200,000 square feet of metal to be exposed to the acid during a period of one hour (that is, approximately $4.8\times10^6$ surface square feet of metal are treated each full operative day). All percentages in the examples are by weight.

EXAMPLE I

A conventional ferrous metal pickling process is used with no system of unused acid recovery. The fresh make-up acid is about 20 Baume' HCl (20 Be' is about 31% HCl with the remaining portion being water.) The average concentration in the first pickling tub is 15% HCl, the average concentration in all of the pickling tubs is 8.5%. The appropriate pickling bath temperature for the above residence time and acid concentration is about 176° Fahrenheit (F.) according to A. N. Winterbottom and J. P. Reed, *Journal of Iron and Steel Inst.*, 159–204, 1932. The metal corrosion rate at this temperature is about 2.7 pounds of metal per each square foot of metal exposed to the acid for a period of one day. Therefore, a total of 11.7 tons of metal are lost to acid corrosion each day and this metal-acid reaction forms a corresponding stoichiometric amount of iron chlorides (mostly ferrous chloride).

On the assumed basis of a medium size steel mill operating about 500 shifts of 8 hours each shift per year, spent pickle liquor production would be in the nature of 5 million gallons per year and comprise about 23% ferrous chloride, 2% HCl, and a remainder portion mostly of water. Energy to heat in the form of open steam is sparged into the first tub or into the other tubs as necessary to retain an operating temperature of about 176° F.

EXAMPLE II

A ferrous metal pickling process is used in combination with a novel pickle liquor unused acid reclamation process as disclosed herein by the embodiment illustrated in FIG. 1. The fresh make-up acid is as in Example I about 31% HCl. The average concentration in the first tub 10 is about 15% HCl. The average concentration throughout all of the tubs is about 11.5% HCl. The appropriate pickling bath temperature for a 2.6 minute metal residence time and the above acid concentration is about 162° F. The metal corrosion rate (which is highly temperature dependent) at this temperature is about 1.7 pounds of metal for each square foot of metal exposed to the acid for a period of one day. Therefore, a total of about 7.7 tons are lost to acid corrosion each day and this metal-acid reaction forms a corresponding stoichiometric amount of iron chlorides. Spent pickle liquor production would be in the nature of 5 million gallons per year comprising about 13.6% ferrous chloride, about 8% HCl, and the remainder portion mostly of water. This spent pickle liquor is transferred to the spent pickle liquor unused acid recovery process. The steel production treated by the pickling process is the same as in Example I. The concentrated spent pickle liquor which is delivered from the unused acid reclamation process to storage is roughly one-third of the volume of spent pickle liquor in Example I or about 1.75 million gallons per year. The concentrated spent pickle liquor is about 36% ferrous chloride, about 0.2% HCl and the remaining portion is composed mostly of water. All of the overheads from the column 33 are returned in a substantially vapor state to the first pickling tub 10 wherein they mix with the fresh make-up acid. The overheads having a composition of about 13% HCl and a remaining portion comprising mostly water. Energy in the form of heat is added to the reboiler tank 37 as closed steam and used to vaporize water therein which strips the HCl from the spent pickle liquor in the column 33; most of this energy is then transferred to the tub 10 for heating the pickle liquor 22 by means of the heat transferred by overhead vapors from the column 33. Additional energy in the form of heat may be added at the tubs 10, 11 12 and 13 if necessary, (for instance, especially on startup). The process preferably is continuously operating in a somewhat steady-state condition, that is there are no major variations in flow rates, pressures or temperature. The equipment of the acid reclamation process as used herein is basically self operating (where necessary automatic controllers operate level, flow and temperature control valves). Hence, very little additional operational labor is required for the unused acid reclamation process as composed to a process having no acid recovery such as Example I.

The benefits of a metal pickling process used with the unused acid reclamation process according to the embodiment in FIG. 1 and as previously described can be compared with a metal pickling process not using an acid reclamation pickling process according to results of Examples I and II respectively. The process according to Example II has the following advantages over Example I.

(a) The pickling bath can be run at a higher concentration in the final tub 13 (also the intermediate tubs 11 and 12 are at a higher average acid concentration), since unused acid is reclaimed and not wasted.

(b) The higher acid concentration allows faster pickling rates or, as shown, allows a reduction in the pickling bath temperature of about 14° F. whereby corrosion of the metal is reduced by about 4.0 tons per day given the assumed pickling rates. This results in savings due to reduced metal loss and reduced acid usage.

(c) The reduction of the pickling bath temperature also results in less heat consumption by the bath in obtaining processing temperature, because metal and pickle liquor are at a lower pickling temperature, and in the reduction of heat loss to vaporization of the pickling liquor while in the pickling bath. Thus there is less heat required for the pickling bath with consequent energy savings.

(d) The amount of spent pickle liquor is reduced by about 3.25 million gallons per year (again under the rates assumed for the examples). This results in reduced storage, transportation, and waste disposal expense. The spent pickle liquor is also concentrated, whereby recovery or beneficial use of the iron chloride may be made without additional expense of concentration.

(e) The spent pickle liquor to storage is substantially reduced in unused acid content (here from 2% by weight in Example I to 0.2% by weight in Example II in a reduced volume as shown in (d) above. This reduces expenses due to neutralization of the acid before disposal and reduces the amount of unused acid lost. Also concentrated metal salt solutions having lower free or unused acid concentrations are more marketable than corresponding solutions having higher free acid concentrations.

(f) The average iron chloride concentration in the pickling bath is reduced. The iron chlorides in the pickle liquor have a corrosive effect on metal and processing equipment which is directly related to concentration, thus creating savings in reduced loss of pickled metal and reduced repair expense of equipment.

In addition to the above benefits, the process of Example II requires little additional operational labor or energy input over the process of Example I.

Also, by way of comparison, typical conventional spent pickle liquor recovery process, such as described by Kolek (J. F. Kolek, "Hydrochloric Acid Recovery Process", *Chemical Engineering Process,* Vol. 69, p. 47 (1973.)), do provide some improvement over a pickling process having no recovery in the nature of reclaiming a portion of the spent pickle liquor unused acid, reducing the amount of the unused or free acid in the spent pickle liquor, and concentrating the spent pickle liquor. However, such a conventional recovery process does not save energy by returning the evaporator overhead vapors directly to the pickling bath before condensation nor yield a concentrated spent pickle liquor solution as low in free acid concentration as can be produced by the inventive process disclosed herein. In addition such conventional processes are typically more expensive than the process disclosed herein both in process equipment, requiring absorbers and attendant apparatus, and in energy cost, requiring separate energy supplies both to heat the evaporator and the pickling bath.

Figure 2:
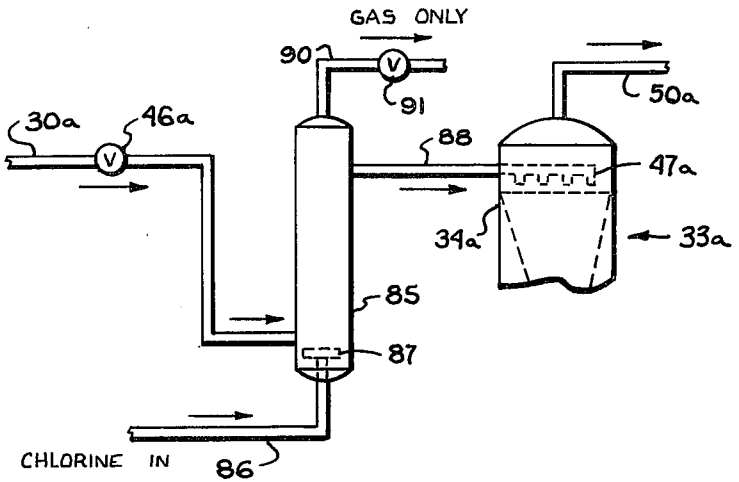
FIG. 2 is a partial schematic flow diagram of an acid reclamation process including a ferrous chloride chlorination process.

A modified embodiment of the invention is illustrated in FIG. 2, wherein a modification is made to a line 30*a* which feeds spent pickle liquor to a column 33*a*. Since the metal pickling process and the acid reclamation process shown in FIG. 2 are otherwise substantially the same as those shown in FIG. 1, similar parts appearing in FIG. 1 and FIG. 2 are respectively represented by the same, corresponding reference numeral except for the addition of the suffix "a" to the numerals in the modified embodiment. The line 30*a* transfers the withdrawn spent pickle liquor to a chlorinator 85. A line 88 transfers the chlorinated spent pickle liquor to the column 33*a* wherein the liquor is dispersed by nozzle 47*a*. Chlorine from a storage area (not shown) is transferred to the chlorinator 85 by a line 86 and distributed therein by a sparging nozzle 87. Excess chlorine is transferred from the top of the chlorinator 85 by a line 90 through a gas pressure control valve 91 to a caustic scrubber (not shown).

As was previously discussed, many processes pickle ferrous metal using hydrochloric acid with the consequent production of ferrous chloride. Thus in the modified process shown in FIG. 2, the spent pickle liquor has a major portion of ferrous chloride therein. This ferrous chloride is not as marketable as ferric chloride, therefore it is desired to convert the former to the latter. The pickle liquor is therefore injected into the chlorinator 85 while chlorine is sparged therethrough. The chlorine mixes with the spent pickle liquor and reacts with a substantial portion of the ferrous chloride therein to produce ferric chloride. The pickle liquor now containing a reduced portion of or negligible ferrous chloride, is injected into column 33*a* through line 88. The remainder of the process is essentially similar to that previously discussed in relation to the process of FIG. 1 except for the following benefits. The chlorine-ferrous chloride reaction is exothermic and thus adds energy in the form of heat to the spent pickle liquor, thereby requiring less heat input into the reboiler tank 37. Also, ferric chloride is normally a more marketable commodity than is ferrous chloride, and ferric chloride does not salt out (come out of solution) as easily as ferrous chloride thereby making processing easier and reducing salt build up on the coil 40 and other processing equipment.

Figure 3:
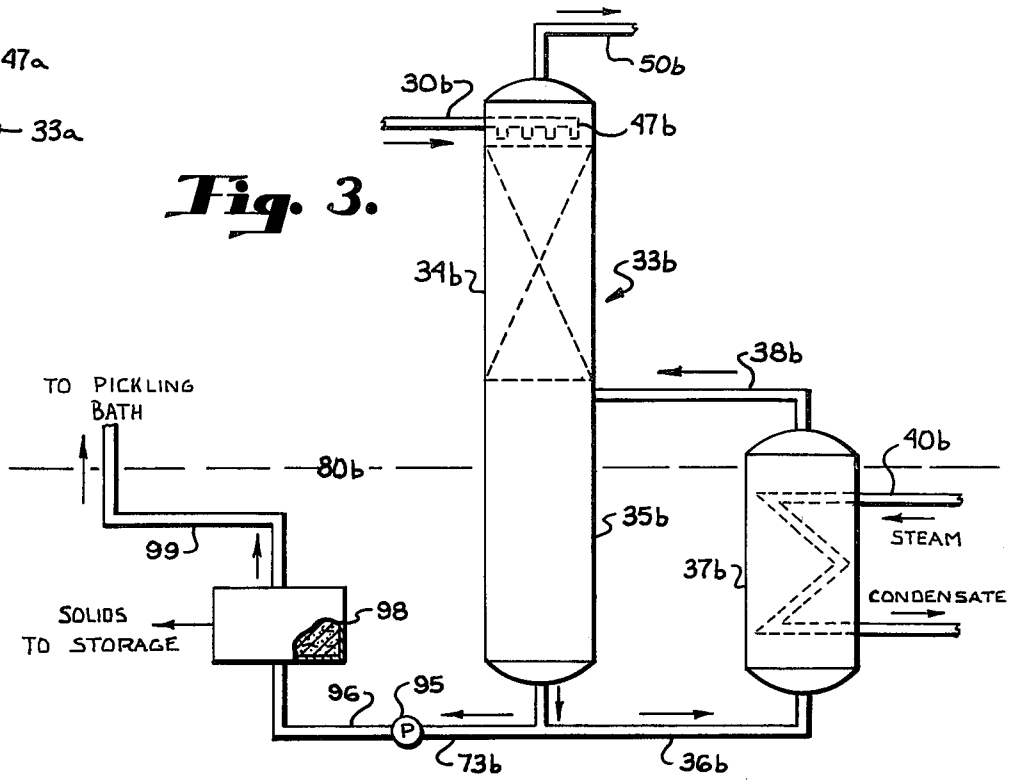
FIG. 3 is a partial schematic flow diagram of an acid reclamation process for relatively non-volatile acids used in a metal pickling process including certain structural features of the processing equipment.

Another embodiment of the invention is shown in FIG. 3, and includes a modification to the unused acid reclamation process to allow recovery of unused acids which are not relatively volatile but where the reaction product metallic salts formed by the reaction of the acid and metal in the metal pickling process will crystallize upon concentration of the pickle liquor withdrawn from the metal pickling process. Since the metal pickling process, including the various lines related thereto, are substantially the same as that shown in FIG. 1, as are many parts of the reclamation process, similar parts appearing in FIG. 1 and FIG. 3 are respectively represented by the same, corresponding reference numeral except for the addition of the suffix "b" to the numerals in this modified embodiment. Many metal pickling processes use acids which are not readily volatilizable as was previously discussed, or use non-volatile in conjunction with volatile acids. Thus, while water can be vaporized from a pickle liquor containing these salts, the non-volatile unused acid cannot be. However, many of the metallic salts formed in metal pickling process crystallize when the spent pickle liquor is concentrated by the evaporation of water. Thus the embodiment of the reclamation process as illustrated in FIG. 3, provides for the return of the unused relatively nonvolatile acids when the metallic salts will crystallize.

A column 33*b* in FIG. 3 may be essentially the same as the column 33 in FIG. 1, especially where the unused acid is a composition of both volatile and nonvolatile acids, such as nitric acid and sulfuric acid. However, the packing in the upper section 34*b* would not be essential if only non-volatile acids were present. The column 33*b* could be any vessel which would contain the spent pickle liquor while heating thereof. The heating means 37*b* used to vaporize the water in FIG. 3 is likewise the same as in FIG. 1, however, any suitable liquid heating source such as an electric heater could also be used. Thus, the acid reclamation process of the present embodiment may be essentially the same as the embodiment as shown in FIG. 1 up to the point where the concentrated spent pickle liquor exits the column 33*b* through line 73*b* with the exception that non-volatile acids do not go through the overheads vapor line 50*b*, however, this is not meant to exclude substitutes of other suitable equipment as discussed above. The metal pickling process associated with the embodiment of FIG. 3 is also essentially the same as the process shown in FIG. 1 with the possible exception of using other or additional acids and/or metals to be pickled than are used according to the embodiment shown in FIG. 1.

As shown in FIG. 3, the concentrated pickling liquor exits the column 33*b* through line 73*b* and is delivered by a pump 95 through line 96 to a filter 98. The solids removed by the filter 98 are delivered to storage from the filter 98. The filtered liquor exits the filter 98 and is returned to the pickling bath through line 99.

While certain equipment is illustrated schematically in FIG. 3, other interchangeable equipment would work suitably as well. Thus, the pump 95 could be replaced by other means of delivering the pickle liquor from the column 33 to the filter 98, such as gravity. Also the filter 98 could be replaced by other means for separating liquids and solids, such as a centrifuge. In addition, the control of the liquid level in the column 35*b* is regulated by an automatic controller (not shown) which operates the pump 95. This level control could be maintained by other devices such as an overflow tank as was previously discussed.

An example of a metal pickling process, wherewith the embodiment illustrated in FIG. 3 could be used, would be a ferrous metal pickling process wherein the pickling acid is sulfuric acid. In this example spent pickle liquor containing major portions of water, ferrous sulfate and sulfuric acid would be delivered to the column 33*b* through line 30*b* and collect in the liquid holding pot 35*b* wherein the level is automatically controlled. The pickle liquor in the holding pot 35*b* is heated by circulation through a thermo-syphon reboiler tank 37*b*, whereby a substantial amount of water is vaporized and returned to the metal pickling process in a vaporized state through the overheads line 50*b* passing through a line 38*b* and the column 33*b*. The spent pickle liquor in the holding pot 35*b* is concentrated by the vaporization of the water such that a major portion of the metallic salt crystallizes, herein ferrous sulfate crystallizes as ferrous sulfate monohydrate. The concentrated spent pickle liquor from the holding pot 35*b* is delivered to the filter 98 wherein the crystals are removed from the liquor. The liquor then exits the filter 98 and is returned to the pickling bath. The metallic salt crystals are removed from the filter 98 by the conventional processes and delivered to storage or other suitable disposition.

The modified embodiment shown in FIG. 3 provides for economization of energy in the form of heat input, as did the embodiment shown in FIG. 1. In the present modified embodiment much of the heat in the steam used to vaporize the water in reboiler tank 37*b* is transferred through the overhead return line 50*b* back to the pickling bath also in the form of heat contained in the vaporized water which is not condensed prior to return to the pickling bath and in the form of heat contained in the preheated acid by return of the unused acid separated from the spent pickle liquor without cooling. Thus, according to the process of the invention, the heat which is normally applied directly to the pickling bath can be applied at the reboiler tank 37*b* with substantially the same heating effect in the pickling bath and still derive the benefits of recovery of unused pickle acid and concentration of the solution containing the metallic salts of the pickling process (here the metallic salts are removed in solid state).

While sulfuric acid is a common pickling acid and was thus discussed in detail above, other nonvolatile acids are not intended to be excluded. Also other metals than ferrous metals are not intended to be excluded. Thus, for instance, the modified embodiment as shown in FIG. 3 would contemplate an aluminum pickling process using phosphoric acid as the pickling acid.

In addition to those metal mentioned in pickling processes hereinbefore described, other metals such as cobalt, copper, lead, magnesium, nickle, silver, titanum, zinc and alloys thereof are also contemplated by the invention. Likewise other acids or mixtures of acids than those mentioned above are also contemplated by the invention, such as organic acids, fluoboric acid, and a mixture comprising nitric acid, hydrochloric acid, or hydrofloric acid.

It is to be understood that while I have illustrated and described certain embodiments of my invention, it is not to be limited to the specific forms or arrangements of equipment, flows, and materials herein described and shown.

Having thus described the invention, what is claimed and desired to secure by Letters Patent is:

1. In combination, a process for pickling ferrous metal and a process for the reclamation of spent pickling acid used therein, comprising the steps of:

(a) providing a hydrochloric acid pickle liquor bath of selected initial concentration of water and hydrochloric acid;

(b) passing said metal through said bath, thereby pickling said metal and generating spent pickle liquor containing portions of ferrous chloride, unused hydrochloric acid, and water;

(c) withdrawing from said bath a portion of the spent pickle liquor, wherein a concentration of said unused hydrochloric acid is substantially less than said initial concentration of said hydrochloric acid;

(d) transferring said withdrawn spent pickle liquor to a container having a stripping section and a liquid holding section;

(d) cascading said withdrawn spent pickle liquor down through said stripping section having multiple stages therein;

(f) collecting said withdrawn spent pickle liquor in said liquid holding section;

(g) applying energy in the form of heat to said collected spent pickle liquor, whereby a portion of the water therein is vaporized from said collected spent pickle liquor; said vaporized water being allowed to rise through said stripping section, whereby said vaporized water strips a substantial portion of said unused hydrochloric acid from said pickle liquor cascading through said stripping section and whereby vaporization of said portion of water concentrates the collected spent pickle liquor;

(h) withdrawing excess concentrated spent pickle liquor including water not vaporized therefrom from said liquid holding section;

(i) returning said vaporized water and said stripped acid in a gaseous state to said acid bath at selected locations; and (j) selectively adding fresh make-up acid to said acid bath; whereby a substantial portion of said energy applied to concentrate said pickle liquor is utilized to warm said acid bath.

2. The combination according to claim 1 wherein:

(a) heat from said withdrawn concentrated spent pickle liquor is transferred to said fresh make-up acid.

3. The combination according to claim 1 wherein:

(a) said heating means comprises a thermo syphon reboiler.

4. The combination according to claim 1 wherein:

(a) each said step is accomplished continously and simultaneously over a substantial period of time.

5. The combination according to claim 1 wherein:

(a) said withdrawal of said concentrated spent pickle liquor from said liquid holding section is controlled by an constant level overflow tank.

6. The combination according to claim 1 including the steps of:

(a) injecting chlorine into said withdrawn pickle liquor before transfer to said container, whereby a substantial portion of the ferrous chloride is converted to ferric chloride.

7. The combination according to claim 1 wherein:

(a) each step is accomplished continuously and simultaneously over a substantial period of time;
(b) heat from said withdrawn concentrated spent pickle liquor is transferred to said fresh make-up acid; and
(c) said heating means comprises a thermo syphon reboiler.

8. A pickling liquor acid reclamation process, said reclamation process comprising the steps of:
(a) withdrawing from ferrous metal pickling process equipment spent pickle liquor comprising water, unused hydrochloric acid and ferrous chloride;
(b) transferring said withdrawn spent pickle liquor to a container having a multi-stage stripping section, a liquid holding section and heating means;
(c) cascading said withdrawn spent pickle liquor down through said stripping section;
(d) collecting the stripped pickle liquor in said liquid holding section of the container;
(e) heating said withdrawn stripped spent pickle liquor by said heating means whereby a portion of said water is vaporized, rises therefrom, passes through the stripping section and thereby strips a major portion of said unused hydrochloric acid from said withdrawn liquor, thereby concentrating said withdrawn pickle liquor by the vaporization of said portion of said water and the stripping of a major portion of said unused hydrochloric acid;
(f) returning said stripped unused hydrochloric acid and said vaporized water together to said ferrous metal pickling process equipment in a gaseous state; and
(g) removing excess said concentrated spent pickle liquor including non-vaporized water from said liquid holding section.

9. The process according to claim 8 wherein:
(a) said heating means is comprised of a thermo syphon reboiler.

10. The process according to claim 8 including the steps of:
(a) controlling removal of said excess concentrated spent pickle liquor from said holding section by a constant level overflow tank.

11. The process according to claim 8 including the step of:
(a) injecting chlorine into said withdrawn liquor before transfer to said container whereby said ferrous chloride is substantially converted to ferric chloride.

12. The process according to claim 9 including the steps of:
(a) controlling removal of said excess concentrated spent pickle liquor from said holding section by a constant level overflow tank; and wherein
(b) each said step is accomplished continuously and simultaneously over a substantial period of time; and
(c) said heating means comprises a thermo syphon reboiler.

13. A phosphoric acid reclamation process in combination with an aluminum pickling process having a pickling bath associated therewith, said reclamation process comprising the steps of:
(a) withdrawing from said pickling bath spent pickle liquor having portions of water, unused phosphoric acid, and aluminum salts; a major portion of said aluminum salts characterized by crystallizing upon concentration of said spent pickling liquor;
(b) transferring said withdrawn liquor to a container having a liquid holding section and a heating means;
(c) heating said withdrawn liquor with said heating means whereby water is vaporized therefrom and whereby said withdrawn liquor is substantially concentrated thereby crystallizing said major portion of the aluminum salts;
(d) returning said vaporized water in a gaseous state to said pickling bath to be used for heating thereof;
(e) separating said crystallized aluminum salts from said concentrated withdrawn liquor whereby said liquor contains as a major component said portion of unused phosphoric acid and is substantially free of said aluminum salts, whereby said liquor is regenerated;
(f) returning said regenerated liquor to said aluminum pickling bath; and
(g) removing said crystallized aluminum salts to storage.

14. The process according to claim 13 wherein:
(a) said separating process comprises centrifugation.

15. The process according to claim 13 wherein:
(a) said separating process comprises filtration.

16. A process for reclaiming a volatile acid from spent pickling-liquor produced by a metal pickling process, said reclaiming process comprising the steps of:
(a) withdrawing said spent pickle liquor from metal pickling process equipment; said spent pickle liquor including portions of water, unused acid selected from the group consisting of hydrofloric acid, nitric acid and mixtures thereof, and metallic salts produced by the metal pickling process;
(b) transferring said spent pickle liquor to a container;
(c) vaporizing a major part of the water from said spent pickle liquor in said container by application of heat thereto, thereby concentrating said spent pickle liquor;
(d) separating a major part of said unused acid from said spent pickle liquor through multi-stage stripping by said vaporized water of said acid from said spent pickle liquor, thereby forming a vaporized water-acid mixture;
(e) returning said water-acid mixture to said pickling process equipment in a gaseous state for heating the pickle liquor contained therein; and
(f) removing said concentrated spent pickle liquor from said container.

17. A process according to claim 16 wherein:
(a) said metal is aluminum metal; and
(b) said unused acid is nitric acid.

* * * * *